US006412272B1

(12) United States Patent
Titterton, III et al.

(10) Patent No.: US 6,412,272 B1
(45) Date of Patent: Jul. 2, 2002

(54) FUEL NOZZLE GUIDE FOR GAS TURBINE ENGINE AND METHOD OF ASSEMBLY/ DISASSEMBLY

(75) Inventors: George F. Titterton, III, South Windsor; Robert J. Selinsky, Jr., Moodus; John William Green, Glastonbury; Randal G. McKinney, Ellington, all of CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/471,579

(22) Filed: Dec. 23, 1999

Related U.S. Application Data

(60) Provisional application No. 60/114,018, filed on Dec. 29, 1998.

(51) Int. Cl.[7] ..... F02C 3/00
(52) U.S. Cl. ..... 60/39.37; 60/737
(58) Field of Search ..... 60/39.31, 737

(56) References Cited

U.S. PATENT DOCUMENTS

| | | | | |
|---|---|---|---|---|
| 4,381,718 A | | 5/1983 | Carver et al. | 110/347 |
| 4,466,240 A | * | 8/1984 | Miller | 60/39.31 |
| 4,946,105 A | | 8/1990 | Pane, Jr. et al. | 239/590.3 |
| 5,044,559 A | | 9/1991 | Russell et al. | 239/406 |
| 5,235,813 A | | 8/1993 | McVey et al. | 60/737 |
| 5,256,352 A | | 10/1993 | Snyder et al. | 261/78.2 |
| 5,263,325 A | | 11/1993 | McVey et al. | 60/738 |
| 5,305,609 A | * | 4/1994 | Guinan et al. | 60/740 |
| 5,406,799 A | * | 4/1995 | Marshall | 60/747 |
| 5,417,070 A | | 5/1995 | Richardson | 60/748 |
| 6,240,731 B1 | * | 6/2001 | Hoke et al. | 239/400 |

FOREIGN PATENT DOCUMENTS

| | | | |
|---|---|---|---|
| EP | 0 073 265 A1 | 3/1983 | F23C/6/04 |
| EP | 0 286 569 | 10/1988 | F23D/11/10 |
| EP | 0 644 375 A2 | 3/1995 | F23K/5/18 |
| EP | 0 646 706 A1 | 4/1995 | F02C/7/232 |
| EP | 0 660 038 A2 | 6/1995 | F23D/11/10 |

* cited by examiner

*Primary Examiner*—Charles G. Freay
*Assistant Examiner*—Ed Hayes
(74) *Attorney, Agent, or Firm*—Ronald G. Cummings

(57) ABSTRACT

A fuel nozzle guide and method of assembly/disassembly is disclosed with the nozzle guide having a frusto-conical hub section, an annular base, a pair of retaining tabs for securing the guide to the outer wall of a combustor bulkhead for limited movement relative to the bulkhead, and a radial inflow swirler. The method of assembly/disassembly comprises assembling/disassembling the nozzle guide in the bulkhead from the outer wall (cold) side of the bulkhead and mechanically connecting/disconnecting the nozzle guide to/from the outer wall of the bulkhead with mechanical fasteners.

19 Claims, 5 Drawing Sheets

FIG.5
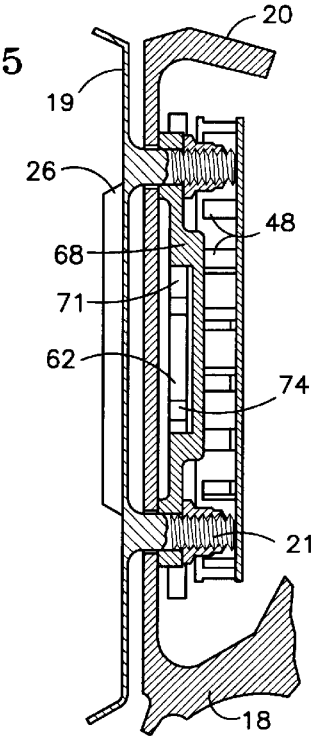
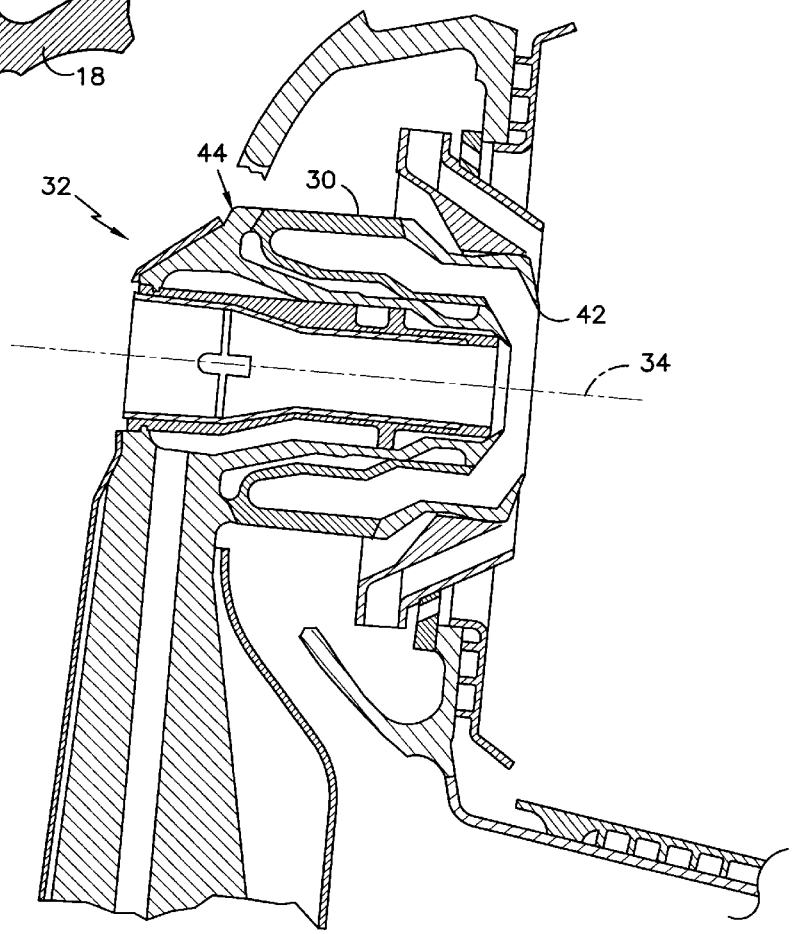
FIG.6

FUEL NOZZLE GUIDE FOR GAS TURBINE ENGINE AND METHOD OF ASSEMBLY/ DISASSEMBLY

This application claims the benefit of U.S. Provisional Application No. 60/114,018, filed Dec. 29, 1998.

TECHNICAL FIELD

This invention relates generally to gas turbine engine combustors and more particularly to a fuel nozzle guide for use in such a combustor.

BACKGROUND OF THE INVENTION

Gas turbine engine combustors include combustion chambers wherein compressed air is mixed with fuel sprayed into the combustion chamber by a fuel nozzle which extends into the combustion chamber through a hole in the chamber bulkhead. The air-fuel mixture is burned thereby increasing the kinetic energy of the resulting gases through the engine to produce useful power for the engine turbine and thrust for the engine.

Typically, a multicomponent fuel nozzle guide for receiving a fuel nozzle extends through an aperture in the chamber bulkhead to maintain the fuel nozzle and nozzle guide in proper alignment with the various other combustion chamber components such as the igniter plug and various air inlet apertures. The nozzle guide also aids in the insertion of the nozzle for combustor assembly and maintenance. Such a nozzle guide usually includes various air apertures for cooling and mixing. The environment within a gas turbine engine is extremely harsh. The air-fuel mixture burns in the combustion chamber at temperatures as high as 2100° C. causing extreme thermal gradients and thermal stresses in the chamber walls. The nozzle guide typically moves with the nozzle and slides with respect to the bulkhead to accommodate thermal growth of the components which might occur at different rates for the components.

In prior nozzle guides such as disclosed in Butler et al., U.S. Pat. No. 5,419,115 issued May 30, 1995 for Bulkhead and Fuel Nozzle Guide Assembly For An Annular Combustion Chamber, the nozzle guide comprises two components. In assembling the nozzle guide in the bulkhead aperture, one component is inserted from the upstream (or "cold") side of the bulkhead and the other component is inserted from the downstream (or "hot") side. The two components are then welded together. The nozzle is thereafter inserted in the nozzle guide from the upstream side. Any service or repair on the combustor which includes removal of the nozzle guide will require the cutting apart of the two nozzle guide components. Suliga, U.S. Pat. No. 4,870,818 issued Oct. 3, 1989 for Fuel Nozzle Guide Structure and Retainer For A Gas Turbine Engine discloses a similar nozzle guide configuration.

It would be desirable to provide a nozzle guide which is attached to the cold side of the bulkhead rather than the harsh, hot side environment. It would also be desirable to provide a nozzle guide that does not require the manufacturing step of welding the nozzle components together during assembly. Further, to facilitate disassembly of the nozzle guide, it would be desirable to eliminate the necessity of a cutting operation.

In addition to mounting the nozzle, the nozzle guide may contribute to fuel mixing in the combustion chamber in particular engine applications. Gas turbine engines emit various pollutants including oxides of nitrogen ("NOx"). NOx is primarily formed through the thermal fixation of nitrogen and results from the high temperature combustion of fuel and air in the gas turbine engine. Environmental concerns and more stringent governmental regulation of NOx emissions have prompted designers to pursue various methods for reducing the generation of NOx by gas turbine engines. Two basic approaches for a low NOx fuel injection system are (1) a locally lean stoichiometry system and (2) a locally rich stoichiometry system. Both approaches require good atomization, mixing and uniformity in the fuel-air mixture. It would be desirable to provide a nozzle guide that complements nozzles of the radial inflow design and that contributes to improved atomization, mixing and/or uniformity in low Nox applications.

SUMMARY OF THE INVENTION

It is an object of the present invention to provide a new and improved fuel nozzle guide which affords ease of assembly and disassembly relative to the combustor bulkhead.

Another object of the invention is to provide an integral, one-piece nozzle guide that is mountable to the combustor bulkhead from one side.

A further object of the invention is to provide a nozzle guide that is attached to the cold side of the combustor bulkhead.

Another object is to provide an alternate embodiment of nozzle guide that can provide swirling air to the fuel-air spray from the nozzle. Included within this objective is the provision of a design that may be used to mount a nozzle of the type having a radial inflow swirler.

A further object is to provide a new and improved method of assembling a nozzle guide to a combustor bulkhead and disassembling the nozzle guide therefrom.

Other objects will be in part apparent and in part pointed out more in detail hereinafter.

Accordingly, it has been found that the foregoing and related objects and advantages are attained in a fuel nozzle guide having a frusto-conical hub section forming a central mounting aperture to receive a fuel nozzle, an annular base, a radial inflow swirler, and a pair of retaining tabs extending from the base for mounting to the outer bulkhead wall of a combustor. In one embodiment each tab has an elongated aperture to mount a bushing secured to the bulkhead wall so as to allow limited movement relative to the bulkhead. In another embodiment, each tab is configured to be received in a slot formed at the bulkhead wall by a retainer secured to the bulkhead wall so as to allow limited movement relative to the bulkhead.

In the method of the present invention, the nozzle guide is inserted into the bulkhead mounting aperture from the cold side of the bulkhead and mechanically secured to the bulkhead wall so as to allow predetermined limited movement relative to the bulkhead to accommodate thermal expansion during operation and fuel nozzle installation. In the method of disassembly, the nozzle guide is mechanically disconnected from the cold side of the bulkhead and withdrawn from the bulkhead mounting aperture.

BRIEF DESCRIPTION OF THE DRAWINGS

FIG. 5 is an elevation view of seen on line 5—5 of FIG. 4.

FIG. 6 is a partly diagrammatic sectional view similar to FIG. 1 with a fuel nozzle mounted in the nozzle guide.

DESCRIPTION OF THE PREFERRED EMBODIMENT

Figure 1:
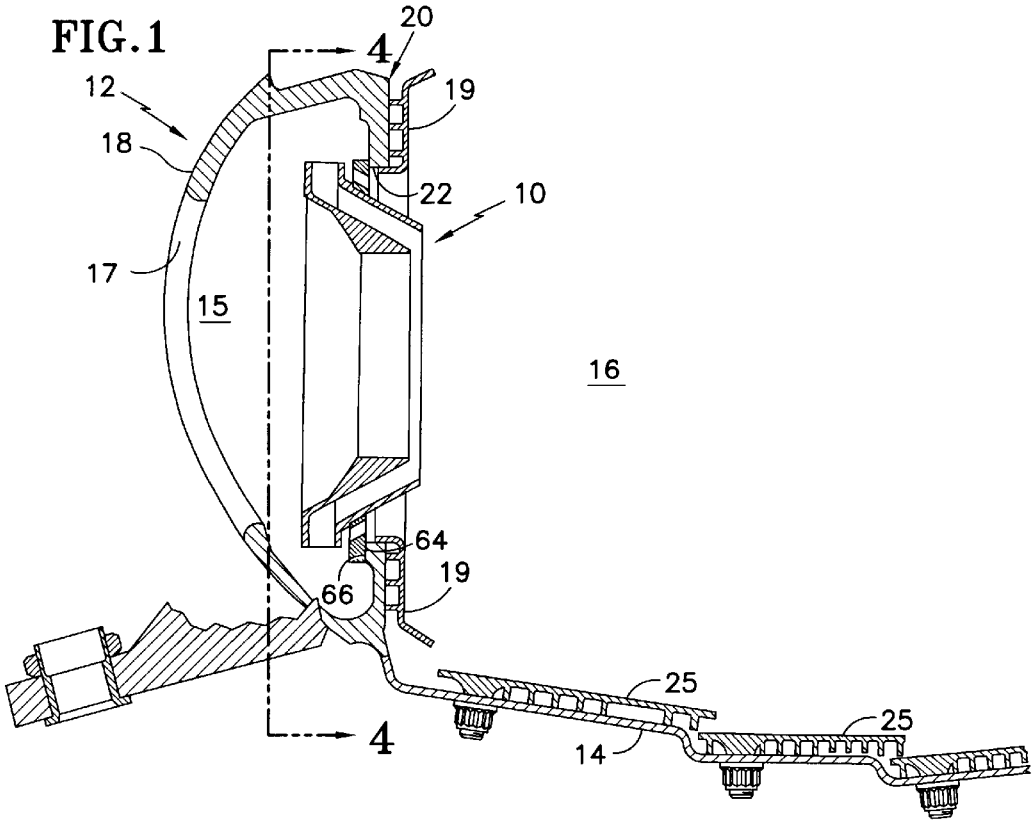
FIG. 1 is a broken away, partly sectional view of a nozzle guide in accordance with the present invention mounted in a combustor bulkhead.

Although specific forms of the present invention have been selected for illustration in the drawings, and the following description is drawn in specific terms for the purpose of describing these forms of the invention, the description is not intended to limit the scope of the invention which is defined in the appended claims.

Referring initially to FIG. 1, the nozzle guide of the present invention is generally designated by the numeral 10 and is shown mounted in the combustor head 12 of a combustion chamber of a gas turbine engine.

The combustion chamber includes an outer liner 14 which extends circumferentially about the axis of the engine and an inner liner (not shown) radially spaced therefrom to form a combustion zone 16 therebetween. The combustor head 12 is at the upstream end of the combustion chamber and includes a circumferentially extending dome 18 and a radially extending bulkhead 20 defining a region 15. A plurality of fuel nozzles (not shown in FIG. 1) are spaced circumferentially about the interior of the engine with each nozzle extending into the combustor head and through the bulkhead 20 to deliver fuel to the combustion zone 16. Each nozzle is received in a nozzle guide 10 which extends through an aperture 22 in the bulkhead. A heat shield 19 is disposed on the downstream or hot side surface 13 of bulkhead 20 about the aperture 22. The heat shield has four bolt members extending axially to engage corresponding holes in the bulkhead. A plurality of additional heat shields 25 (only some of which are shown)are disposed about the interior of the combustion chamber. Additional detail concerning the combustion chamber structure may be found in Butler et al., U.S. Pat. No. 5,419,115 issued May 30, 1995 for Bulkhead and Fuel Nozzle Guide Assembly For An Annular Combustion Chamber which is incorporated herein by reference.

Figure 2:
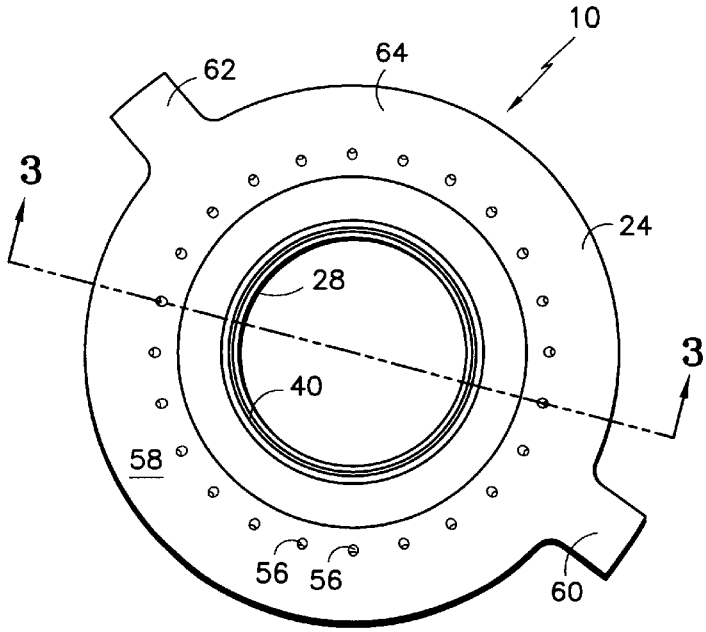
FIG. 2 is an enlarged elevation view of the guide of FIG. 1.
Figure 3:
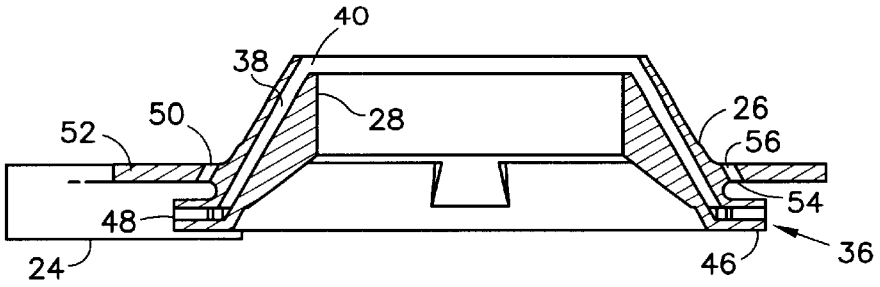
FIG. 3 is a sectional view seen on line 3—3 of FIG. 2.

Referring to FIGS. 2 and 3, the nozzle guide 10 has a generally annular base 24 with an outwardly extending frusto-conical hub section 26 forming a central mounting aperture 28 dimensioned for snug slip-fit mounting of the head 30 of nozzle 32 (FIG. 6). The centerline of the guide (not shown) is concurrent with the centerline 34 of head 30 when it is mounted within the guide 10.

The guide 10 includes a radial inflow swirler 36. The swirler 36 has a frusto-conical air passage 38 formed in the hub section 26 concentric to centerline 34 (when nozzle head 30 is mounted in the guide 10) with an annular outlet end 40. The outlet 40 is concentric about and adjacent to the outlet 42 of the swirler 44 of nozzle 32 when nozzle 32 is mounted in aperture 28 (FIG. 6). The inner end 46 of passage 38 is positioned in the annular base 24 and has a plurality of equi-spaced, circumferentially disposed air inlet ports 48. The ports 48 open radially outwardly for the radial inflow of air into the passage 38. As seen in FIG. 3, the frusto-conical passage 38 generally converges radially inwardly as the passage extends longitudinally from the inner end 46 to the outlet end 40 such that a progressively converging helical air pathway is followed by the swirled air. The swirled air from outlet 40 is directed into the fuel-air mixture from the nozzle head 30 producing a more uniform fuel-air mixture with rapid mixing.

The guide 10 also includes an additional air source into the fuel-air mixture in the form of a plurality of axial inflow air passages 50 in a flange portion 52 of base 24. Each passage 50 has an inlet end 54 and an outlet end 56 (FIG. 3) and is disposed generally parallel to passage 38, i.e., extending outwardly from the base and radially inwardly. The outlets 56 are disposed in a concentric array about the outlet 40 of swirler 36. It is believed that air from the outlets purges the area about the nozzle and contributes to the mixing and flow of the fuel-air mixture. Alternately, the passages 50 can be disposed to provide some swirl to the discharged air.

The flange portion 52 of the base 24 has a planar surface 58 and a pair of radially-extending tabs 60,62 for retaining the guide in position within the bulkhead aperture. When the guide is mounted in assembly with the bulkhead 20, the hub section 26 extends through the bulkhead aperture 22 with the array of air outlets 56 facing downstream and being disposed radially within the aperture 22. The planar surface 58 has an annular area 64 radially outward from the array of air outlets that engages and rides on an upstream-facing annular pad or seal land 66 formed in the bulkhead 20 about the aperture 22 (FIG. 1). The start up pressure in the dome region 15 seats the annular area 64 against the annular pad for proper sealing between the guide and bulkhead.

Figure 4:
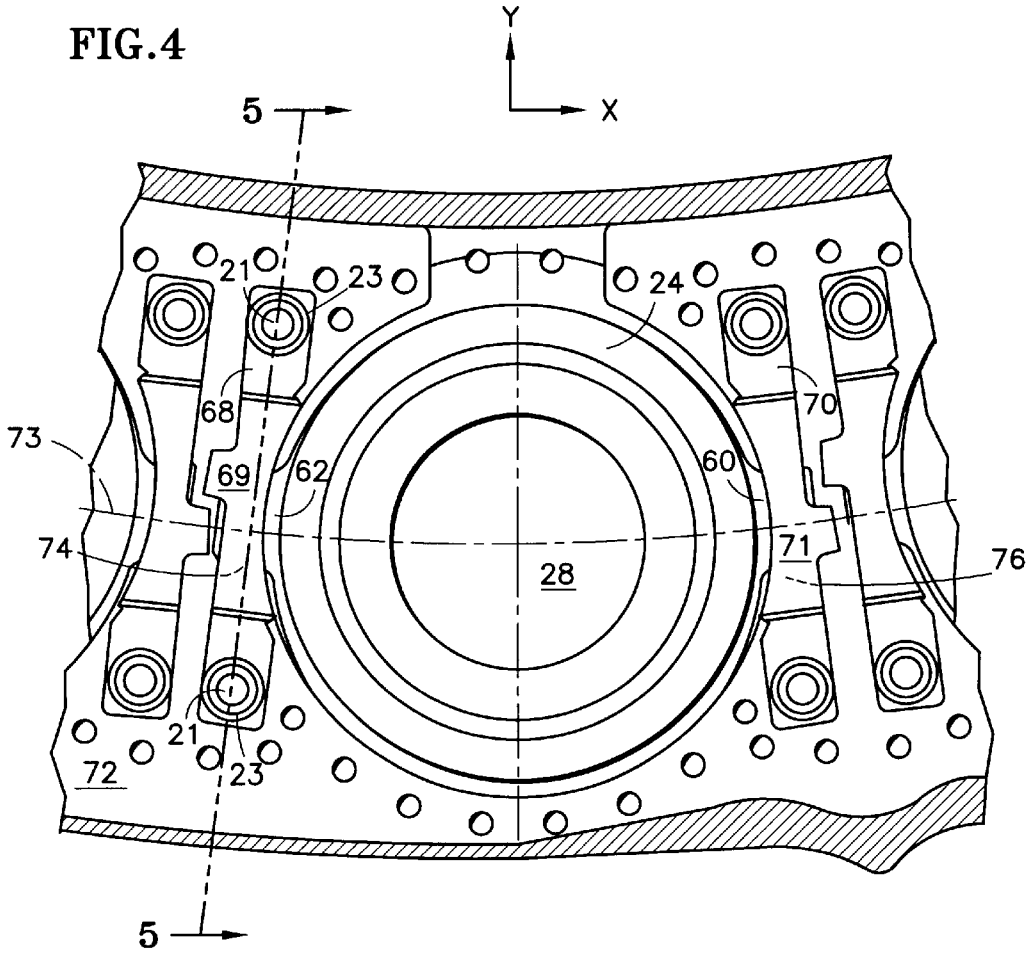
FIG. 4 is a broken away, enlarged elevation view seen on line 4—4 of FIG. 1.

Referring to FIGS. 4 and 5, the guide is retained to the bulkhead by pair of retainers or plates 68,70 so as to allow limited movement as described hereinafter. The retainers are positioned on opposed sides of the guide 10 generally orthogonal to the centerline 73 of aperture 22. The retainer 68 is mounted to the upstream surface 72 of the bulkhead and has a stepped middle section 69 so as to form a slot 74 between the surface 72 and the section 69 which receives the tab 62. Similarly, the retainer 70 has a stepped middle section 71 and is mounted to the surface 72 to form a slot 76 between the surface 72 and the section 71 to receive the tab 60. The retainers 68,70 have bolt apertures (not shown) and are secured to the bulkhead by bolt members 21 and nuts 23 which also secure the heat shield 19 to the bulkhead. The slots 74,76 are dimensioned to receive the tabs 62,60 respectively and allow limited movement, i.e., the tabs 60,62 are deemed to "float" under the retainers 70,68 respectively. In the described embodiment, the bulkhead aperture 22 is dimensioned relative to the hub section 26 to allow the guide to move +/−0.180" in the X direction and +/−0.200" in the Y direction (as shown in FIG. 4). This gapping is desirable to allow for the considerations of detail part tolerances, fuel nozzle installation and thermal growth of the hardware during operation. The number of tabs and relative position may be varied according to application.

In assembling the guide 10 to the bulkhead 20, the guide 10 is inserted through the aperture 17 in dome 18. The aperture 17 is oblong to facilitate insertion, i.e., by tilting the guide and inserting it more or less sideways through the aperture 17 into the region 15. The hub section 26 is positioned in the aperture 22 of the bulkhead such that the surface 58 of the flange portion 52 of the base 24 engages the raised pad 66 of the bulkhead. The guide is rotated so that the tabs 60,62 are generally aligned with the centerline 73. The retainers 68,70 are then mounted on the bolt members 21 and secured with the nuts 23. Welding is not required and simple hand tools (e.g., a wrench) may be utilized to secure the retainer and the guide in place. The head 30 of nozzle 32 is then inserted through aperture 17 in the dome and into the central aperture 28 of the guide 10 for snug, slip-fit mounting therein.

In disassembling for service or repair, the guide 10 is removed by first disengaging the nuts 23 from the bolt members 21. Retainers 68,70 are then removed from the bolt members to free the guide from the bulkhead. The nozzle is first separated from the guide and the guide then removed from the bulkhead. Accordingly, disassembling for service or repair is easily and quickly accomplished without out the need for cutting.

Figure 7:
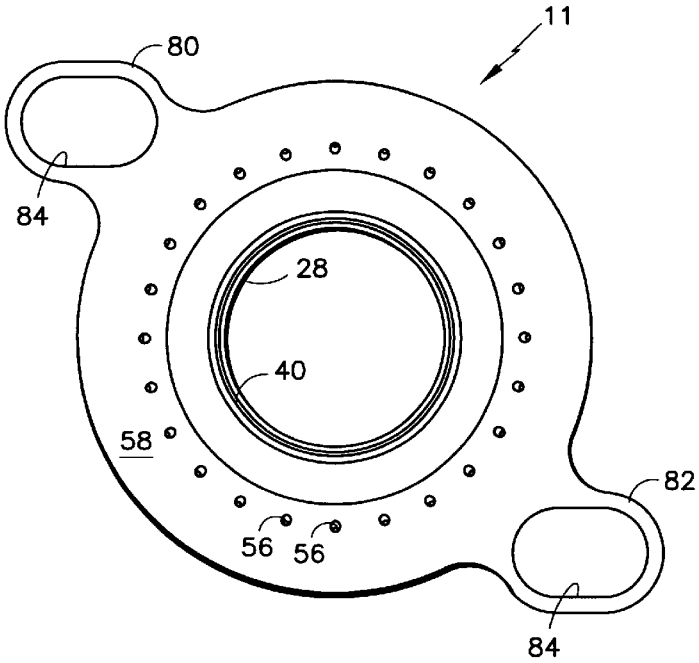
FIG. 7 is an enlarged elevation view of an alternate embodiment of the nozzle guide of the present invention.
Figure 8:
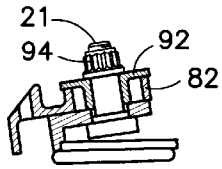
FIG. 8 is a sectional view of a bushing for retaining the nozzle guide of FIG. 7 to the bulkhead.

Referring to FIG. 7, an alternate embodiment guide is shown and generally designated by the numeral 11 and wherein identical numerals are utilized to identify like or similar parts with guide 10. The flange portion 52 has a pair of diametrically-opposed, radially-extending tabs 80,82. Each tab 80,82 has an oblong aperture or slot 84. In assembly, a bolt member 21 of a heat shield extends through each aperture 84 to secure the guide to the bulkhead. The bolt member 21 mounts a bushing 92 which is positioned in the slot 84 and secured by a nut 94. Referring to FIG. 8, an example bushing is shown in cross section secured by the nut 94. The apertures 84 and bushings 92 are dimensioned and positioned relative to the bulkhead to permit guide movement similar to the embodiment of FIG. 1, e.g., +/−0.080" in the X direction, +/−0.200" in the Y direction and +/−0.010" in the Z direction. The limited movement in the X direction is attained from clearance between the bushing 92 and the aperture 84. The limited movement in the Y direction is attained from the elongation dimension of the aperture 84. The limited movement in the Z direction is attained from the clearance between the bushing and the nozzle guide. The retaining force of the nut and bushing must be sufficient to withstand any reverse flow conditions such as occurs during engine/compressor stall. Further, the guide 11 is sized to insure that the start-up pressure in the dome region 15 will be able to seat the guide 11 against the seal land of the bulkhead for proper sealing between the guide and the bulkhead.

Aerodynamically, the guide 11 is configured as guide 10 with an addition that each air inlet port 48 has an adjoining swirl vane surface 86 disposed at a predetermined swirl angle to impart swirl to the inflowing air. The angle of the vane surface determines the amount of swirl imparted to the inflowing air and the vane surfaces 86 may by positioned to provide either clockwise or counterclockwise swirl, i.e., co-swirl or counter-swirl relative to the swirl from the swirlers in the nozzle, depending upon application.

Figure 9:
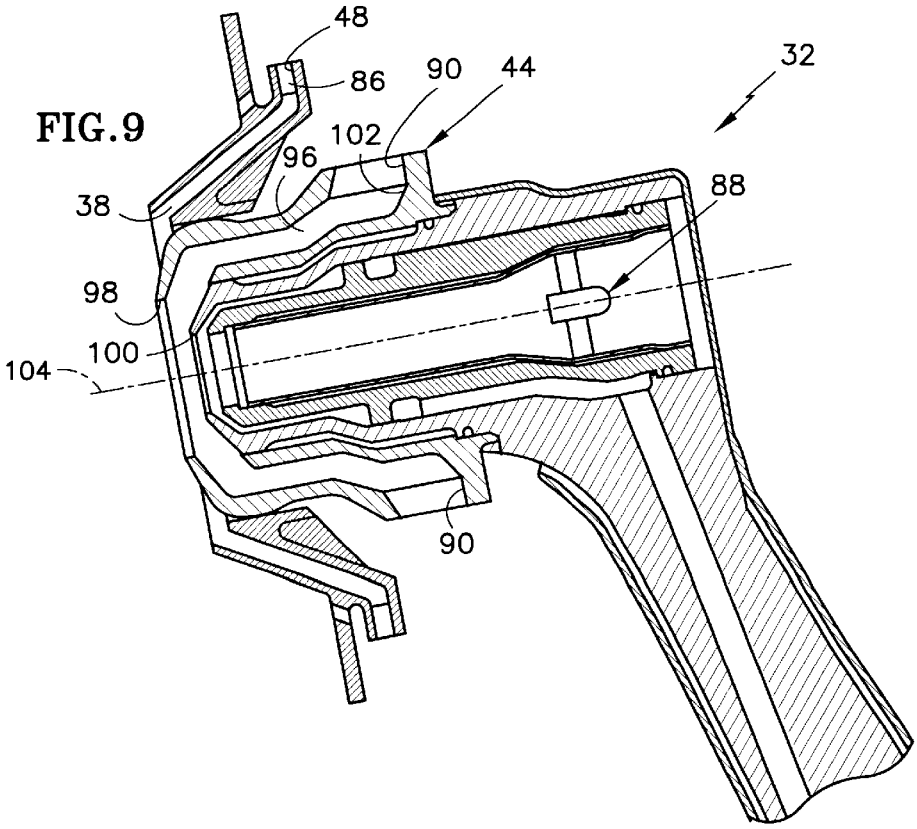
FIG. 9 is a sectional side view, partly broken away, of the guide of FIG. 7 with a fuel nozzle mounted in the guide.
Figure 10:
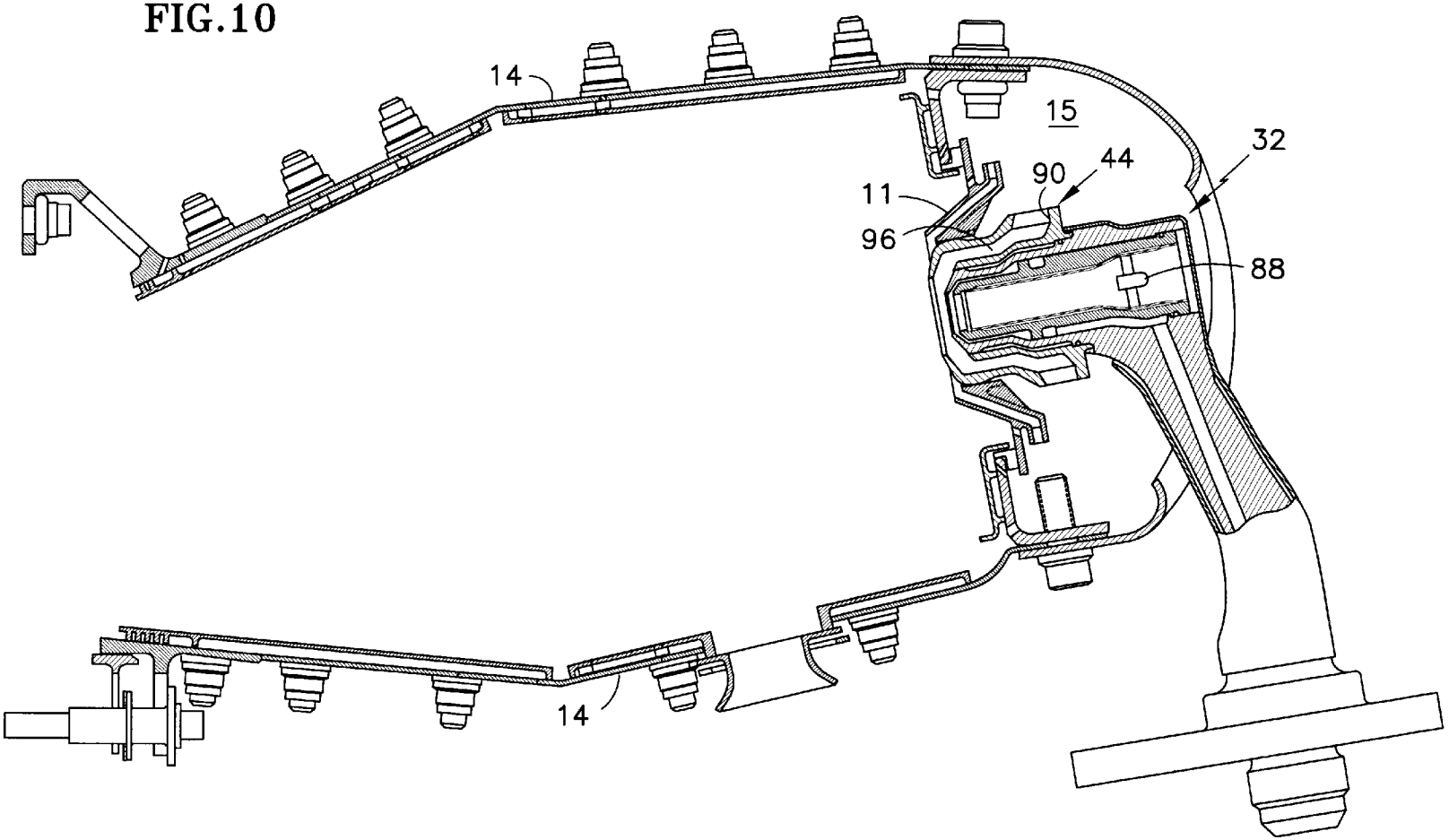
FIG. 10 is a partly diagrammatic sectional side view of the nozzle and guide assembly of FIG. 9 mounted in a gas turbine engine combustor.

Referring to FIG. 10, the guide 11 is shown mounted in assembly with the nozzle 32. The nozzle 32 is of the radial inflow swirler design having a radial inflow swirler 44 (in addition to an axial swirler 88). Referring to FIG. 9, an enlarged sectional view of the nozzle 32 is shown in assembly with the guide 11. The ports 90 open radially outwardly for the radial inflow of air into the passage 96. The passage 96 is an annular passage concentric to the centerline 104 with an outlet end 98 adjoining the fuel discharge outlet 100 and an inner end 102 connected to the ports 90. As can be seen, the guide 11 is positioned downstream from the radial swirler inlet ports 90 so as not to interfere with air flow into the inlet ports 90. Overall the guide 11 is aerodynamically configured to complement and contribute to the atomization and mixing action of the nozzle. A detailed description of the nozzle and operation is found in the commonly assigned U.S. patent application of Hoke et al., Ser. No. 000,897 filed Dec. 30, 1998 entitled Fuel Nozzle and Nozzle Guide For Gas Turbine Engine which is incorporated herein by reference.

As will be appreciated from the foregoing, a new and improved nozzle guide has been described which affords ease of assembly and disassembly without the need of welding or cutting respectively and which is mountable to the combustor bulkhead from one side. In this regard, a new and improved method of assembly/disassembly is also described. Further, an alternate embodiment can provide swirling air to the fuel-air spray from the nozzle to improve atomization, mixing and/or uniformity.

As will be apparent to persons skilled in the art, various modifications and adaptations of the structure above-described will become readily apparent without departure from the spirit and scope of the invention, the scope of which is defined in the appended claims.

What is claimed is:

1. A gas turbine engine fuel nozzle guide for mounting in a combustor bulkhead aperture to receive and align a fuel nozzle through a bulkhead of a combustor of a gas turbine engine, said guide comprising:

a frusto-conical hub section having a forward end and a rearward end and forming a central mounting aperture dimensioned to slidably receive and align a fuel nozzle;

an annular base disposed at said rearward end of said hub section;

a pair of retaining tabs extending radially from said base, said retaining tabs being configured for movable mounting to one side of a bulkhead of a combustor; and a radial inflow swirler having a frusto-conical air passage in said hub section with an inlet end and an outlet end, said outlet end being disposed at said forward end of said hub section and concentric to said central mounting aperture and said inlet end having a plurality of circumferentially disposed air inlet ports in said base with said ports opening radially outward for radial inflow of air into said air passage.

2. The device of claim 1 wherein each said retaining tab has an elongated aperture dimensioned and configured to receive a bushing secured to an outer bulkhead wall of a combustor for limited movement of said nozzle guide relative to said bulkhead.

3. The device of claim 1 wherein said retaining tabs are oppositely disposed on said base.

4. The device of claim 2 wherein the bulkhead aperture has a longitudinal axis and defines an x axis orthogonal to a y axis with said x and y axes being orthogonal to said longitudinal axis and said elongated slot of each said tab is dimensioned to allow limited movement of said nozzle guide along said x and y axis.

5. The device of claim 4 wherein said limited movement is a predetermined value to accommodate thermal expansion during gas turbine engine operation and fuel nozzle installation.

6. The device of claim 1 wherein each said tab is configured for slidable retention in a corresponding retainer slot formed on an outer bulkhead wall of a combustor for limited movement of said nozzle guide relative to said bulkhead.

7. The device of claim 6 wherein said tab is rectangular and each said slot is formed by a retainer plate mounted to the outer bulkhead wall.

8. The device of claim 7 wherein the bulkhead aperture has a longitudinal axis and defines an x axis orthogonal to a y axis with said x and y axes being orthogonal to said longitudinal axis and each said tab and slot are cooperatively dimensioned to allow limited movement of said nozzle guide along said x and y axis.

9. The device of claim 8 wherein said limited movement is a predetermined value to accommodate thermal expansion during gas turbine engine operation and fuel nozzle installation.

10. The device of claim 1 wherein said base comprises an array of air passages about said frusto-conical air passage, each said air passage extending generally axially relative to said frusto-conical air passage and having an inner inlet end opening axially to receive axial inflow air and an outer outlet end disposed to direct air toward the outlet end of the frusto-conical air passage, said outlet ends of said array of air passages being disposed in a concentric array about the outlet end of the frusto-conical air passage.

11. The device of claim 1 wherein said fuel nozzle guide is integrally formed for subsequent mounting in a combustor bulkhead aperture.

12. A method of assembling a fuel nozzle guide in a bulkhead of a combustor in a gas turbine engine where (a) the combustor bulkhead has an inner wall facing the combustion area, and outer wall facing away from the combustion area and a nozzle-nozzle guide mounting aperture extending through the bulkhead between the inner and outer wall and (b) the nozzle guide is of the type of integral construction having a frusto-conical hub section having a forward end and a rearward end and forming a central mounting aperture dimensioned to slidably receive and align a fuel nozzle and an annular base disposed at said rearward end of said hub section, the method of assembly comprising:

positioning the nozzle guide in the bulkhead aperture from the outer wall side of the bulkhead so that the base is adjacent the outer wall; and mechanically securing the base to the outer wall so as to allow limited movement of the nozzle guide relative to the bulkhead.

13. The method of claim 12 wherein the step of securing the base to the outer wall comprises securing the by mechanical fasteners to the outer wall for limited movement.

14. The method of claim 13 wherein the step of securing the base to the outer wall comprises securing the base by threaded fasteners.

15. The method of claim 12 wherein the step of securing the base to the outer wall comprises securing the base to the outer wall with a tab-slot connection for limited movement.

16. The method of claim 15 wherein the base of the nozzle guide has a pair of retaining tabs and the step of securing the base to the outer wall with a tab-slot connection comprises forming a slot on the outer wall about each tab after the nozzle guide has been positioned in the bulkhead aperture.

17. A method of disassembling a fuel nozzle and fuel nozzle guide from a bulkhead of a combustor in a gas turbine engine where (a) the combustor bulkhead has an inner wall facing the combustion area, and outer wall facing away from the combustion area and a mounting aperture extending through the bulkhead between the inner and outer wall, (b) the nozzle guide is positioned in the bulkhead mounting aperture and mechanically secured to the outer wall of the bulkhead, and (c) a fuel nozzle is slidably mounted in the nozzle guide and extending through bulkhead aperture, the method of disassembly comprising:

slidably withdrawing, from the outer wall side of the bulkhead, the fuel nozzle from the nozzle guide;

mechanically disconnecting the nozzle guide from the outer wall of the bulkhead; and withdrawing, from the outer wall side of the bulkhead, the nozzle guide from the bulkhead aperture.

18. The method of claim 17 wherein the nozzle guide is mechanically secured to the outer wall of the bulkhead by threaded fasteners and the step of mechanically disconnecting the nozzle guide from the outer wall comprises mechanically disconnecting the threaded fasteners.

19. The method of claim 17 wherein the nozzle guide is mechanically secured to the outer wall of the bulkhead by a tab-slot connection with the tab being formed on the nozzle guide and the slot being formed by a retainer plate secured to the outer wall by mechanical fasteners and the step of mechanically disconnecting the nozzle guide from the outer wall comprises mechanically disconnecting the mechanical fasteners to remove the retainer plates.

* * * * *